United States Patent [19]

Hebda

[11] Patent Number: 4,883,256

[45] Date of Patent: Nov. 28, 1989

[54] PICKET FENCE AND METHOD OF CONSTRUCTION

[76] Inventor: Thomas J. Hebda, 539 S. Park, Lombard, Ill. 60148

[21] Appl. No.: 299,674

[22] Filed: Jan. 23, 1989

[51] Int. Cl.[4] ..... B21F 27/00

[52] U.S. Cl. ..... 256/22; 403/347; 256/34

[58] Field of Search ..... 256/21, 22; 52/667, 52/669; 403/347

[56] References Cited

U.S. PATENT DOCUMENTS 189,543 4/1877 VanDorn ..... 256/22

FOREIGN PATENT DOCUMENTS 334726 3/1921 Fed. Rep. of Germany ..... 256/22

21710 of 1893 United Kingdom ..... 256/21

*Primary Examiner*—Andrew V. Kundrat

*Attorney, Agent, or Firm*—Edmond T. Patnaude

[57] ABSTRACT

A picket fence assembly having upper and lower rails each with a plurality of non-circular holes receiving a plurality of vertical pickets through respective aligned holes and with the pickets having transverse through-holes in alignment and receiving a rigid transverse rod preventing rotations of the pickets.

5 Claims, 1 Drawing Sheet

PICKET FENCE AND METHOD OF CONSTRUCTION

The present invention relates in general to picket fencing, and it relates more particularly to a picket fence construction wherein the pickets are rotatably locked to the rails.

BACKGROUND OF THE INVENTION

My copending application Ser. No. 07/200,431 filed on May 31, 1988, discloses a picket fence construction wherein top and bottom horizontal rails are provided with triangular openings into which the end portions of complimentary triangular pickets are inserted. The pickets are provided with indentations at the locations of the rails to permit rotation of the pickets into locking engagement with the rails. Decorative caps are slidably mounted on the pickets and include fingers which depend into the respective openings in the rails adjacent the pickets to prevent spurious rotation of the pickets and subsequent disassembly of the fence. In those applications where the picket fence is used for purposes of security it is important to prevent the surreptitious disassembly of the pickets.

SUMMARY OF THE INVENTION

Briefly, in accordance with a preferred embodiment of the present invention the individual pickets are provided with horizontal through-holes at the location of at least one of the rails and a single locking rod is inserted coaxially through the through-holes in all of the pickets when the pickets are in the locked positions. The locking rod, which thus prevents rotation and subsequent disassembly of the pickets, cannot be withdrawn from the rail to release the pickets until the rail has been disassembled from the end posts or other structure to which the rail is connected.

GENERAL DESCRIPTION OF THE DRAWING

Further objects and advantages and a better understanding of the present invention will be had by reference to the following detailed description taken in connection with the accompanying drawing wherein.

DETAILED DESCRIPTION OF A PREFERRED EMBODIMENT OF THE INVENTION

Figure 1:
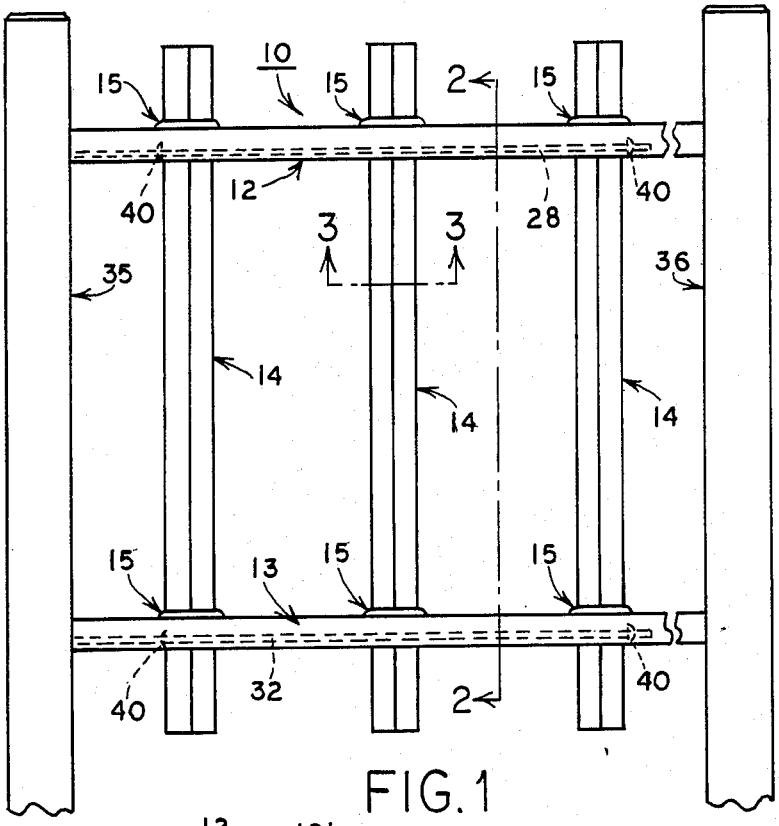
FIG. 1 is a front elevational view of a portion of a picket fence embodying the present invention.
Figure 2:
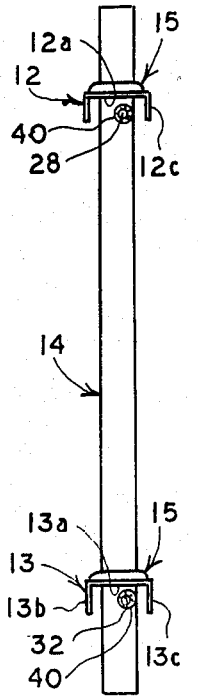
FIG. 2 is a cross-sectional view taken along the line 2—2 of FIG. 1.

Referring to FIG. 1 there is shown a section of a picket fence 10 which may be seen to consist of an upper horizontal rail 12, a lower horizontal rail 13, a plurality of vertical pickets 14 and a plurality of decorative caps 15. As best shown in FIG. 2, the upper rail 12 is an inverted channel member, preferably formed of metal, and includes a horizontal web **12*a* and depending side flanges 12*b* and 12*c*. The lower rail 13 is identical in construction to the upper rail 12 and includes a web 13*a* and depending side flanges 13*b* and 13*c***.

Figure 3:
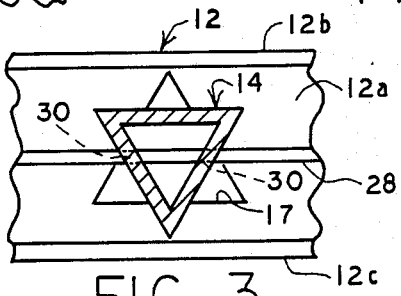
FIG. 3 is a fragmentary bottom view of the fence of FIG. 1 showing the connection of one of the pickets to the top rail.
Figure 4:
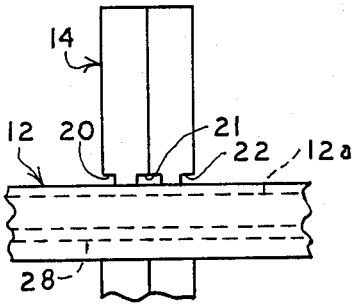
FIG. 4 is a front elevational view, partially broken away, showing one of the pickets and the associated portion of the top rail.

As shown in FIG. 3, the web **12*a* of the upper rail is provided with a plurality of triangular openings 17, and the cross sectional configuration of the pickets 14 are complimentary thereto so as to be insertable through the opening 17. Identical triangular openings are provided in the web 13*a* in alignment with the openings 17 in the upper rail. The pickets 14 are provided with three indented grooved portions 20, 21 and 22 the disposition at the location of the rail 12 and a similar set of indentations 24, 25 and 26 are provided for disposition at the location of the rail 13. The two sets of indentations are thus respectively spaced apart the same distance as the rails 12 and 13 so that the indentations may be respectively aligned with the webs 12*a* and 13*a* of the upper and lower rails. When assemblying a section of the fence the pickets 14 are inserted into the openings 17 in the upper and lower rail members so that the two sets of indentations are respectively aligned with the webs 12*a* and 13*a*. The position of the picket relative to the upper rail 12 is best shown in FIG. 4. With the picket in this position, it is then rotated or twisted through an angle of about forty-five degrees until the upper edge portions of the indentations rest on the associated web 12*a* and 13*a*. When all of the pickets have thus been assembled to the upper and lower rails 12, a rigid locking rod 28 is inserted through holes 30 in the pickets 14. All of the holes 30 will be in mutual alignment when the pickets 14 are in the locked position as shown in the FIG. 3 so that the rod 28 may be readily inserted through them as shown in FIGS. 1 and 3. With the rod 28 thus in place the pickets 14** cannot be rotated to the position where they may be withdrawn from the rails.

If desired, a second rod 32 may be inserted through aligned holes 33 provided near the bottom of the pickets 14 within the space between the lower flanges **13*b* and 13*c* of the rail 13. With the rods 28 and 32** located between the flanges of the upper and lower rails they are not generally visible and do not detract from the appearance of the fence.

The ends of the rails 12 and 13 are attached to upstanding posts 35 and 36 in any suitable manner such as that shown in my co-pending application Ser. No. 07/200,431, filed May 31, 1988. Where desired, however, the ends of the rails 12 and 13 may be attached to a building structure or the like. When the rails are thus attached to some upstanding structure whether it be an end post or a building or the like, the rods 28 and 32 cannot be withdrawn from the pickets until the rails have been disassembled and moved away from the end structure. This makes it extremely difficult for anyone to surreptitiously disassemble the pickets from the rails to gain access through the fence.

Figure 6:
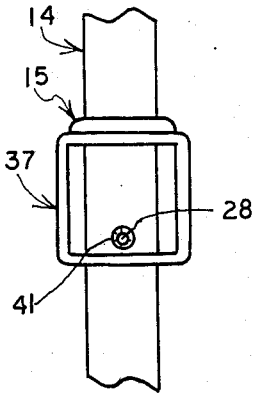
FIG. 6 is an end view of the upper portion of a fence embodying another feature of the present invention.
Figure 5:
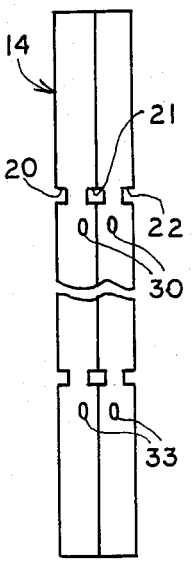
FIG. 5 is a fragementary elevational view of one of the pickets in the fence shown in FIG. 1.

Referring to FIG. 6 there is shown an alternative embodiment of the invention wherein tubular members 37 (only one of which is shown) constitute the upper and lower horizontal rails. In this embodiment the locking rods extend through the rails and are inaccessible until the rails are disassembled from the end posts or building to which they are mounted.

In accordance with another feature of the invention a plurality of retaining rings are fitted over the rods to prevent axial movement of the rods until the rings 40 have been removed. Preferably, the rings are radially slit washers formed of spring metal and pressed onto the locking rods and tightly against the outer sides of the outer pickets as shown in FIGS. 1 and 2. Similar locking rings 41 may be used with the embodiment shown in FIG. 6.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed:

1. A picket fence assembly, comprising in combination upper and lower horizontal rails each having a plurality of non-circular through-holes therein, a plurality of vertically disposed pickets arranged in mutually parallel relationship between said rails and extending through respectively aligned ones of said through-holes in said rails, said pickets being respectively in said through-holes from an assembly position wherein said pickets are axially movable in said through-holes to a locking position wherein vertical movement of said pickets relative to said rails is prevented, said pickets being provided with transverse through-holes which are in mutual alignment when each of said pickets is in said locking position, and a rigid rod slidably extending through said transverse through-holes in said pickets to prevent rotation of said pickets from said locking positions to said assembly positions.

2. A picket fence assembly according to claim 1 wherein at least one of said rails includes of a web and two depending side flanges, and said rod is located in the space between said side flanges.

3. A picket fence assembly according to claim 1 wherein at least one of said rails is tubular, and said rod extends through said at least one of said rails.

4. A picket fence assembly according to claim 1, comprising a locking ring affixed to said rod adjacent to one of said pickets.

5. A picket fence according to claim 4 wherein at least one of said rails is tubular, and said rod extends through said at least one of said rails.

* * * * *

UNITED STATES PATENT AND TRADEMARK OFFICE

CERTIFICATE OF CORRECTION

PATENT NO. : 4,883,256

DATED : November 28, 1989

INVENTOR(S) : Thomas J. Hebda

It is certified that error appears in the above—identified patent and that said Letters Patent is hereby corrected as shown below:

Claim 1, line 9, the word "rotatable" should be inserted after -respectively-.

Signed and Sealed this

Ninth Day of October, 1990

*Attest:*

HARRY F. MANBECK, JR.

*Attesting Officer*

*Commissioner of Patents and Trademarks*